United States Patent [19]

Kanzaka

[11] 3,956,802

[45] May 18, 1976

[54] RACK FOR ADJUSTABLE FASTENING DEVICE

[75] Inventor: Yoshihiro Kanzaka, Nyuzen, Japan

[73] Assignee: Yoshida Kogyo Kabushiki Kaisha, Japan

[22] Filed: Nov. 19, 1974

[21] Appl. No.: 525,093

[30] Foreign Application Priority Data

Nov. 21, 1973 Japan ..... 48-134846[U]

[52] U.S. Cl. ..... 24/206 B; 24/206 R; 2/237

[51] Int. Cl.[2] ..... A44B 19/00; A44B 11/00

[58] Field of Search ..... 24/206 R, 206 B; 2/237

[56] References Cited

UNITED STATES PATENTS

| | | | |
|---|---|---|---|
| 374,648 | 12/1887 | Altman | 24/206 R |
| 1,908,232 | 5/1933 | Freysinger | 24/206 R |
| 1,957,257 | 5/1934 | Freysinger | 24/206 R |
| 2,438,933 | 4/1948 | Markin | 2/237 |
| 2,605,064 | 7/1952 | Davis | 24/206 R |
| 2,618,036 | 11/1952 | Statham | 24/206 B |
| 2,895,170 | 7/1959 | Carlile | 24/206 B |
| 3,147,522 | 9/1964 | Schumm | 24/206 R |
| 3,259,951 | 7/1966 | Zimmerman | 24/201 C |

FOREIGN PATENTS OR APPLICATIONS

| | | | |
|---|---|---|---|
| 170,060 | 9/1934 | Switzerland | 24/206 B |

*Primary Examiner*—Bernard A. Gelak
*Attorney, Agent, or Firm*—Bucknam and Archer

[57] ABSTRACT

An adjustable fastening device broadly comprises a slider and a rack, the slider being slidably mounted astride the rack so as to be releasably locked at any point on the latter for adjustably fastening parts pats of an article, or two separate articles, together. The rack has a pair of transversely registered recesses formed in the respective longitudinal edges thereof to provide a guideway through which the slider can be manipulated to and away from an astride position on the rack.

2 Claims, 5 Drawing Figures

RACK FOR ADJUSTABLE FASTENING DEVICE

BACKGROUND OF THE INVENTION

This invention relates generally to adjustable fastening devices, and in particular to an adjustable fastening device of the type comprising a rack and a slider, the latter being releasably lockable in any selected position on the former so that articles, or parts of an article, attached to these two major components of the device can be adjustably fastened to each other. The invention is more specifically directed to the improved construction of the rack designed to permit the slider to be readily mounted on or dismounted from the same.

The adjustable fastening devices of the indicated type have been used extensively on the waistbands of garments such as trousers, skirts and jackets to properly fit the same on the wearer. Heretofore, the rack of the adjustable fastening device has been fabricated complete with a terminal stop at one end only to limit the movement of the slider therealong. The other end of the rack is so configured as to permit the slider to be mounted astride the same, so that another terminal stop must be affixed to the said other end of the rack after the slider has been mounted astride thereon. This operation is complicated and disadvantageous in that the rack is assembled with the slider in the limited manner. Furthermore, when the slider suffers some trouble in the use of the adjustable fastening device, its replacement cannot be effected unless one of the terminal stops is removed from the rack.

SUMMARY OF THE INVENTION

In view of the noted inconveniences of the prior art, it is a principal object of this invention to provide an adjustable fastening device broadly comprising a rack and a slider, wherein the rack is so fashioned as to permit the slider to be readily manipulated to or away from its proper operative position on the rack without impairment of any existing part of the device.

Another object of the invention is to provide, in the adjustable fastening device of the type described, a rack which is simple in construction, easy to maufacture, and well adapted for use with a slider of no special construction.

Briefly, the adjustable fastening device to which the invention is directed is of the type comprising a rack attached to a first article part, and a slider attached to a second article part. The slider is adapted to be slidably mounted astride the rack and can be releasably locked at any point on the latter for adjustably fastening the first and second article parts together. Characteristically, the rack has a pair of transversely registered recesses formed in the respective longitudinal edges thereof to provide a guideway through which the slider can be manipulated to and away from an astride position on the rack. The manipulation of the slider to and away from the astride position will be materially facilitated if the recesses are arranged at an angle to the longitudinal direction of the rack.

The features which are believed to be novel and characteristic of this invention are set forth with particularity in the appended claims. The invention itself, however, both as to its construction and manner of functioning, together with the further objects and advantages thereof, will become more apparent and understandable as the description proceeds, with reference taken to the accompanying drawings in which like reference characters denote corresponding parts of the several views.

DESCRIPTION OF THE PREFERRED EMBODIMENTS

Figure 1:
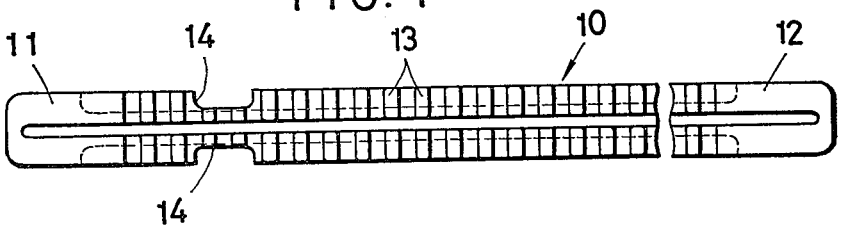
FIG. 1 is a top plan view of a rack for an adjustable fastening device constructed according to the novel concepts of this invention.
Figure 2:
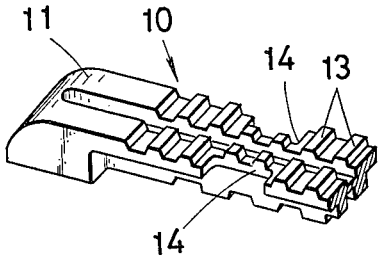
FIG. 2 is an enlarged, fragmentary perspective view of the rack shown in FIG. 1.

FIGS. 1 and 2 of the drawings best illustrate the general configuration of a preferred form of the rack for an adjustable fastening device according to the invention. The illustrated rack 10 is made of relatively hard but suitably flexible material such for example as plastics. The rack 10 comprises integral terminal stops 11 and 12 between which there are arranged two parallel rows of intersticed teeth 13. According to the novel concepts of this invention, a pair of transversely registered recesses 14 are formed in the respective longitudinal edges of the rack 10. Although the recesses 14 are shown to be located adjacent the terminal stop 11, it is to be understood that such recesses can be formed at any point between both extremities of the rack.

Figure 3:
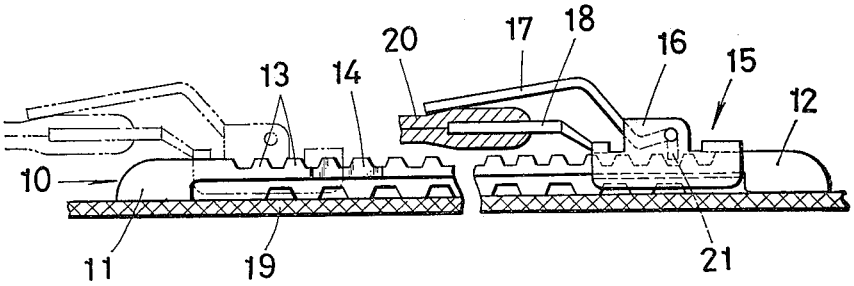
FIG. 3 is a side elevational view of the adjustable fastening device incorporating the rack shown in FIGS. 1 and 2.

With reference to FIG. 3, a slider 15 for use with the rack 10 can be of the well known type comprising a body 16, a locking or clamping member 17 movably mounted on the slider body, and an anchoring member 18 extending rearwardly from the slider body. The length of the slider body 16 should be suitably greater than the width of each recess 14 formed in the rack 10.

Also as illustrated in FIG. 3, the rack 10 is sewn or otherwise attached to a desired part 19 of a garment or like article with which the adjustable fastening device is to be used. The slider 15, on the other hand, is attached to another article part 20 via its anchoring member 18. In the use of this adjustable fastening device the slider 15 is slidably mounted astride the rack 10, and when the locking member 17 is pivoted to the position shown in FIG. 3, a hook or pawl 21 on one of is ends engages in the interstice between the adjacent teeth 13 on the rack so that the two article parts 19 and 20 can be adjustably fastened together.

Figure 4:
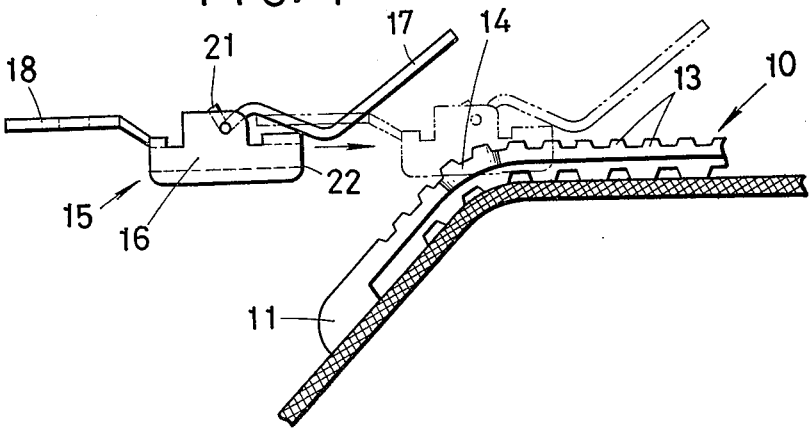
FIG. 4 is a fragmentary side elevational view explanatory of the manner of manipulating the slider onto the rack in the adjustable fastening device shown in FIG. 3.

FIG. 4 is explanatory of a manner of mounting the slider 15 astride the rack 10 which has been fabricated complete with its terminal stops 11 and 12 and which has already been attached to the article part 19. The rack 10 together with the article part 19 is bent at a suitable angle at the point where the recesses 14 are formed, and the slider 15 is then manipulated, with its open end 22 foremost, to an astride position on the rack through the guideway formed by the recesses 14, as indicated by the dot-and-dash lines in FIG. 4.

The rack and slider assembly can thus be readily completed. It should be appreciated that the provision of the transversely registered pair of recesses 14 in the respective longitudinal edges of the rack according to the invention can be useful regardless of whether the rack is of the type fabricated complete with both terminal stops or of the conventional type in which one of the terminal stops is to be affixed after the slider has been mounted thereon. Replacement of the slider, when damaged or otherwise put out of order, with a new one is also materially made easy by the provision of the recesses 14.

Figure 5:
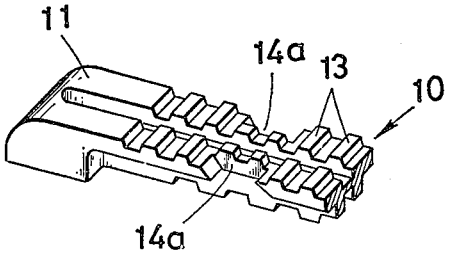
FIG. 5 is a view similar to FIG. 2 but illustrating another preferred embodiment of the invention.

FIG. 5 illustrates one of the possible modifications of the preceding embodiment of the invention, in which the recesses 14*a* are arranged at an angle to the longitudinal direction of the rack 10 to provide a slanting guideway for the slider such as that labeled 15 in FIGS. 3 and 4. This arrangement is in contrast to the preceding embodiment in which the recesses 14 are so formed as to provide the guideway generally vertically disposed in the plane of the rack. The slanting guideway shown in FIG. 5 is well calculated to facilitate the manipulation of the slider to and away from its astride position on the rack.

It is to be understood that the preferred forms of the rack set forth hereinbefore are purely by way of example and not of a limitative nature. Also, the structural details of the adjustable fastening device shown in the accompanying drawings are not meant to impose limitations upon the scope of the invention, as the inventive concepts are obviously applicable to other devices of more or less identical construction. It will indeed be easy for those skilled in the art to resort to various modifications or changes, without departing from the spirit or scope of the invention as sought to be defined by the following claims.

What is claimed is:

1. In an adjustable fastening device of the type comprising a rack attached to a first part, and a slider attached to a second part, said slider being adapted to be slidably mounted astride said rack and to be releasably locked in any selected position on the latter for adjustably fastening said first and second parts together, the improvement wherein said rack is flexible and has a pair of transversely registered recesses formed in the respective longitudinal edges thereof, each of said recessed having a smaller width than the length of said slider in such a manner that said pair of recesses define, when said rack is bent at a given angle at the point where the recesses are formed, a guideway through which said slider can be manipulated to and away from an astride position on said rack.

2. The improvement as set forth in claim 1, wherein said recesses are arranged at an angle to the longitudinal direction of said rack to provide a slanting guideway facilitating the manipulaton of said slider to and away from the astride position on said rack.

* * * * *